US010226674B2

(12) United States Patent
Ivanic et al.

(10) Patent No.: US 10,226,674 B2
(45) **Date of Patent: *Mar. 12, 2019**

(54) PROJECTILE LAUNCHING DEVICE

(71) Applicant: Imperial Toy, LLC, North Hills, CA (US)

(72) Inventors: Robert J. Ivanic, Saugus, CA (US); Tyler James Russell, Los Angeles, CA (US); Joseph Wong Wai Ching, Hong Kong (CN); Lee Ronald Loetz, Valley Village, CA (US)

(73) Assignee: Imperial Toy LLC, North Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/340,922

(22) Filed: Nov. 1, 2016

(65) Prior Publication Data

US 2017/0209758 A1 Jul. 27, 2017

Related U.S. Application Data

(63) Continuation of application No. 14/630,555, filed on Feb. 24, 2015, now Pat. No. 9,480,895, which is a (Continued)

(51) Int. Cl.
*F41B 3/00* (2006.01)
*A63B 65/12* (2006.01)
(Continued)

(52) U.S. Cl.
CPC ..... *A63B 65/122* (2013.01); *A63B 59/02* (2013.01); *A63B 59/20* (2015.10); *A63B 60/10* (2015.10); *A63B 60/34* (2015.10); *A63B 60/50* (2015.10); *F41B 3/00* (2013.01); *A63B 21/4021* (2015.10); *A63B 60/20* (2015.10)

(58) Field of Classification Search
CPC ..... F41B 3/00; A63B 59/02; A63B 65/122
See application file for complete search history.

(56) References Cited

U.S. PATENT DOCUMENTS 1,585,446 A * 5/1926 Warwick ..... A63B 59/20 124/5
3,049,352 A * 8/1962 Hancock ..... A63B 59/80 124/5

(Continued)

OTHER PUBLICATIONS

USPTO; Non-Final Office Action dated Sep. 11, 2013 in U.S. Appl. No. 13/343,660.

(Continued)

*Primary Examiner* — John Ricci
(74) *Attorney, Agent, or Firm* — Snell & Wilmer L.L.P.

(57) ABSTRACT

A launching device comprises a shaft having a first end and a second end, a head coupled to the first end of the shaft and a handle coupled to the second end of the shaft. The head comprises a cavity and a launch ramp curved both upwardly and outwardly from the cavity, wherein a distal portion of the launch ramp extends outwardly beyond the cavity in a forward launching direction. An angle is defined by the longitudinal grip axis and the distal portion of the launch ramp to direct a projectile disposed in the cavity in the forward launching direction.

19 Claims, 6 Drawing Sheets

Related U.S. Application Data continuation of application No. 13/343,660, filed on Jan. 4, 2012, now Pat. No. 8,960,172.

(51) Int. Cl.

| | |
|---|---|
| ***A63B 59/02*** | (2006.01) |
| ***A63B 60/34*** | (2015.01) |
| ***A63B 60/10*** | (2015.01) |
| ***A63B 59/20*** | (2015.01) |
| ***A63B 60/50*** | (2015.01) |
| *A63B 21/00* | (2006.01) |
| *A63B 60/20* | (2015.01) |

(56) References Cited

U.S. PATENT DOCUMENTS 4,157,828 A * 6/1979 Cosmopulos ..... A63B 59/30 124/5
4,972,884 A * 11/1990 Souers ..... B65G 69/0458 141/1
7,686,001 B2 * 3/2010 Fitt ..... A63B 59/20 124/5
8,302,585 B2 * 11/2012 FitzGerald ..... F41B 3/04 124/5
8,517,003 B2 * 8/2013 Fisher ..... F41B 3/04 124/5
8,960,172 B2 * 2/2015 Ivanic ..... A63B 65/122 124/5
9,480,895 B2 * 11/2016 Ivanic ..... A63B 65/122
2010/0018510 A1 * 1/2010 Shoaff ..... A63B 59/20 124/5

OTHER PUBLICATIONS

USPTO; Non-Final Office Action dated Feb. 25, 2014 in U.S. Appl. No. 13/343,660.
USPTO; Notice of Allowance dated Oct. 8, 2014 in U.S. Appl. No. 13/343,660.
USPTO; Non-Final Office Action dated Oct. 6, 2015 in U.S. Appl. No. 14/630,555.
USPTO; Final Office Action dated Apr. 13, 2016 in U.S. Appl. No. 14/630,555.
USPTO; Notice of Allowance dated Jul. 6, 2016 in U.S. Appl. No. 14/630,555.
Wikipedia contributors. "Jai alai." Wikipedia, The Free Encyclopedia. Wikipedia, The Free Encyclopedia, Jul. 5, 2018. Web. Jul. 31, 2018.

* cited by examiner

PROJECTILE LAUNCHING DEVICE

CROSS-REFERENCE TO RELATED APPLICATIONS

This patent application is a continuation of and claims priority to U.S. application Ser. No. 14/630,555, filed Feb. 24, 2015, now U.S. Pat. No. 9,480,895, issued Nov. 1, 2016, which is a continuation of U.S. application Ser. No. 13/343,660, filed Jan. 4, 2012, now U.S. Pat. No. 8,960,172, issued Feb. 24, 2015, which applications are herein incorporated by reference in their entirety.

FIELD OF THE INVENTION

This invention relates to a projectile launching device and, more particularly, to a projectile launching device that is particularly suited for launching water balloons at an intended target.

BACKGROUND

A water balloon or water bomb is a latex rubber balloon filled with water. Because of how water balloons' latex breaks under stress, they are often thrown and launched at targets, resulting in wetness. They are commonly used in water balloon fights and for purposes of carrying out practical jokes.

Water balloons are typically thrown or lobbed by a user at an intended target. Because water balloons, by nature, have an amorphous and changing shape, it is often difficult to accurately aim and throw a water balloon and actually hit an intended target. This difficulty is compounded when the intended target is located at a distance that is outside of one's throwing range.

Various devices have been developed to allow a user to throw water balloons at greater distances and hit the intended target at greater accuracy. One such device is a water balloon sling shot, which typically comprises a soft pocket in which the water balloon is placed, and an elastic material on either sides of the pocket. The Y-shaped frame, typical of the traditional slingshots, is usually omitted so as to accommodate a variety of water balloon shapes and sizes. As a result, the operation of a water balloon slingshot may require up to three people to launch a balloon, with two people holding the two ends of the elastic material and one person to retract the pocket and water balloon.

While there are other water balloon launchers that may require only a single person for operation, they are typically rather unwieldy or expensive. For example, there are launchers that make use of compressed air to push a water balloon out of a barrel, marketed under the name "Balloon Bazooka."

BRIEF SUMMARY

The embodiments of the launching devices disclosed herein overcome many of the drawbacks of known water balloon devices. It provides ease of operation in requiring only a single operator or user to launch the water balloons, while providing greater accuracy due to the configuration of the cavity in which the water balloon is held and the configuration of the launching surface from which it is propelled. Moreover, the launching device requires a simple range of motion in order to propel the water balloon towards its intended target. This simple range of motion may be either an overhead or underhand swing movement.

In one embodiment, a launching device comprises a shaft having a first end and a second end, a head coupled to the first end of the shaft and a handle coupled to the second end of the shaft. The head comprises a cavity and a launch ramp curved both upwardly and outwardly from the cavity, wherein a distal portion of the launch ramp extends outwardly beyond the cavity in a forward launching direction. An angle is defined by the longitudinal grip axis and the distal portion of the launch ramp to direct a projectile disposed in the cavity in the forward launching direction.

In accordance with a first aspect of the embodiment, the angle is greater than or equal to 90 degrees.

In accordance with a second aspect of the embodiment, the angle is in the range of from 110 to 170 degrees.

In accordance with a third aspect of the embodiment, the launch ramp has a radius of curvature that increases from the cavity to the distal portion.

In accordance with a fourth aspect of the embodiment, a proximal portion of the launch ramp adjacent the cavity is curved and the distal portion of the launch ramp is substantially planar.

In accordance with a fifth aspect of the embodiment, the shaft is angled relative to the grip axis so as to position the head at a distance away from the grip axis in a direction opposing the forward launch direction.

In accordance with a sixth aspect of the embodiment, a rolling surface is defined by the inner surface of the cavity and the launch ramp, wherein the rolling surface is specifically adapted to allow for the smooth rolling of a water balloon, and wherein the rolling surface is devoid of any protrusions or gaps which would create friction when the water balloon is rolled thereon.

In accordance with a seventh aspect of the embodiment, a guard member disposed alongside at least the grip section of the handle. The guard member may be configured to shield an entire side of the grip section in the forward launching direction.

In accordance with an eighth aspect of the embodiment, the launch ramp further includes a plurality of apertures.

In accordance with a ninth aspect of the embodiment, the launching device further comprises a looped member disposed on the handle.

In accordance with a tenth aspect of the embodiment, the cavity of the launching device is a pocket comprising walls that encircle a water balloon disposed therein.

In another embodiment, a launching device comprises a shaft having a first end and a second end, a head coupled to the first end of the shaft, and a handle coupled to the second end of the shaft. The head comprises a cavity and a curved launch ramp extending from the cavity and outwardly toward a forward launching direction. The handle comprises a grip section. The head is displaced at a distance away from the grip axis and in a direction opposing the launching direction.

In accordance with a first aspect of the embodiment, the cavity comprises an inner surface which is substantially smooth and devoid of any sharp edges.

In accordance with a second aspect of the embodiment, a rolling surface is defined by the inner surface of the cavity and the launch ramp, wherein the rolling surface is specifically adapted to allow for the smooth rolling of a water balloon, and wherein the rolling surface is devoid of any protrusions or gaps which would create friction when the water balloon is rolled thereon.

In accordance with a third aspect of the embodiment, the launch ramp has a radius of curvature that increases from the cavity to the distal portion.

In accordance with a fourth aspect of the embodiment, the shaft further comprises a curved shaft section between the first and second end, the curved launch ramp and the curved shaft section forming a sigmoidal curve.

In accordance with a fifth aspect of the embodiment, a guard member disposed alongside at least the grip section of the handle. The guard member may be configured to shield an entire side of the grip section in the forward launching direction.

In accordance with a sixth aspect of the embodiment, the launch ramp further includes a plurality of apertures.

In accordance with a seventh aspect of the embodiment, a looped member is disposed on the handle.

Other objects, features and advantages of the present invention will become apparent to those skilled in the art from the following detailed description.

BRIEF DESCRIPTION OF THE DRAWINGS

Illustrative embodiments of the present invention are described herein with reference to the accompanying drawings, in which.

Like numerals refer to like parts throughout the several views of the drawings.

DETAILED DESCRIPTION OF THE PREFERRED EMBODIMENTS

Figure 1:
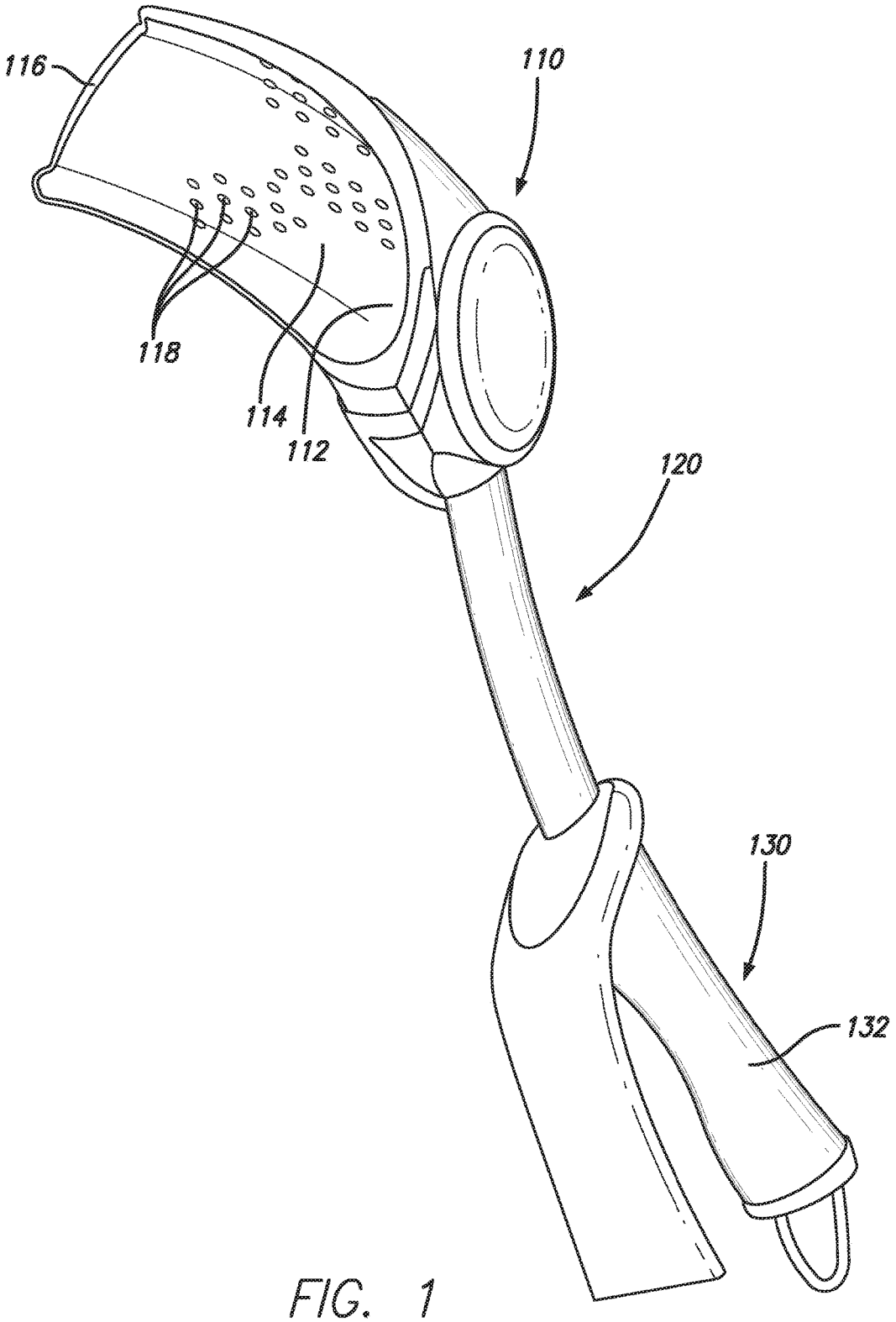
FIG. 1 is a perspective view of an embodiment of the launching device.
Figure 2:
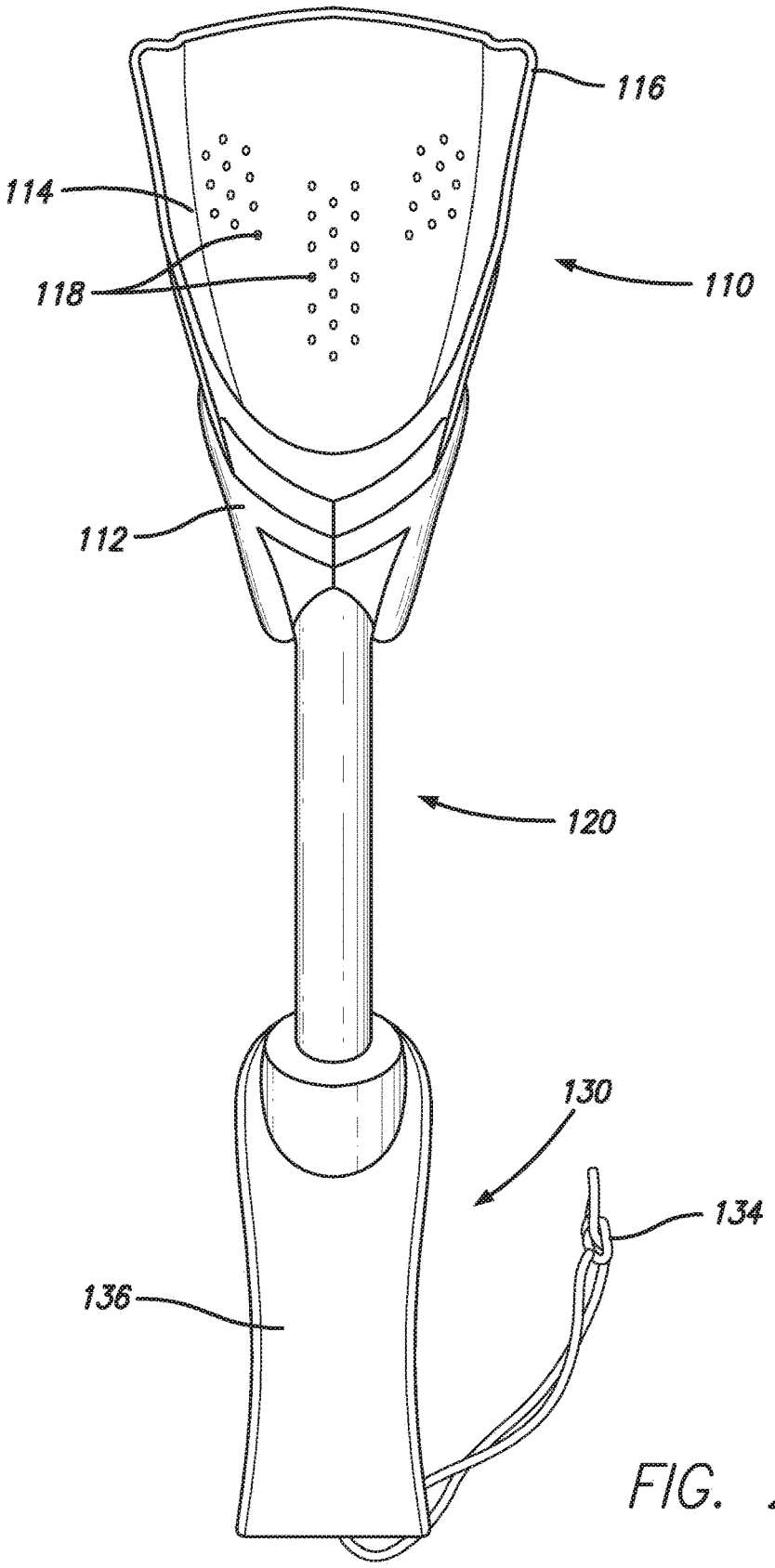
FIG. 2 is a front view of the launching device of FIG. 1.
Figure 3:
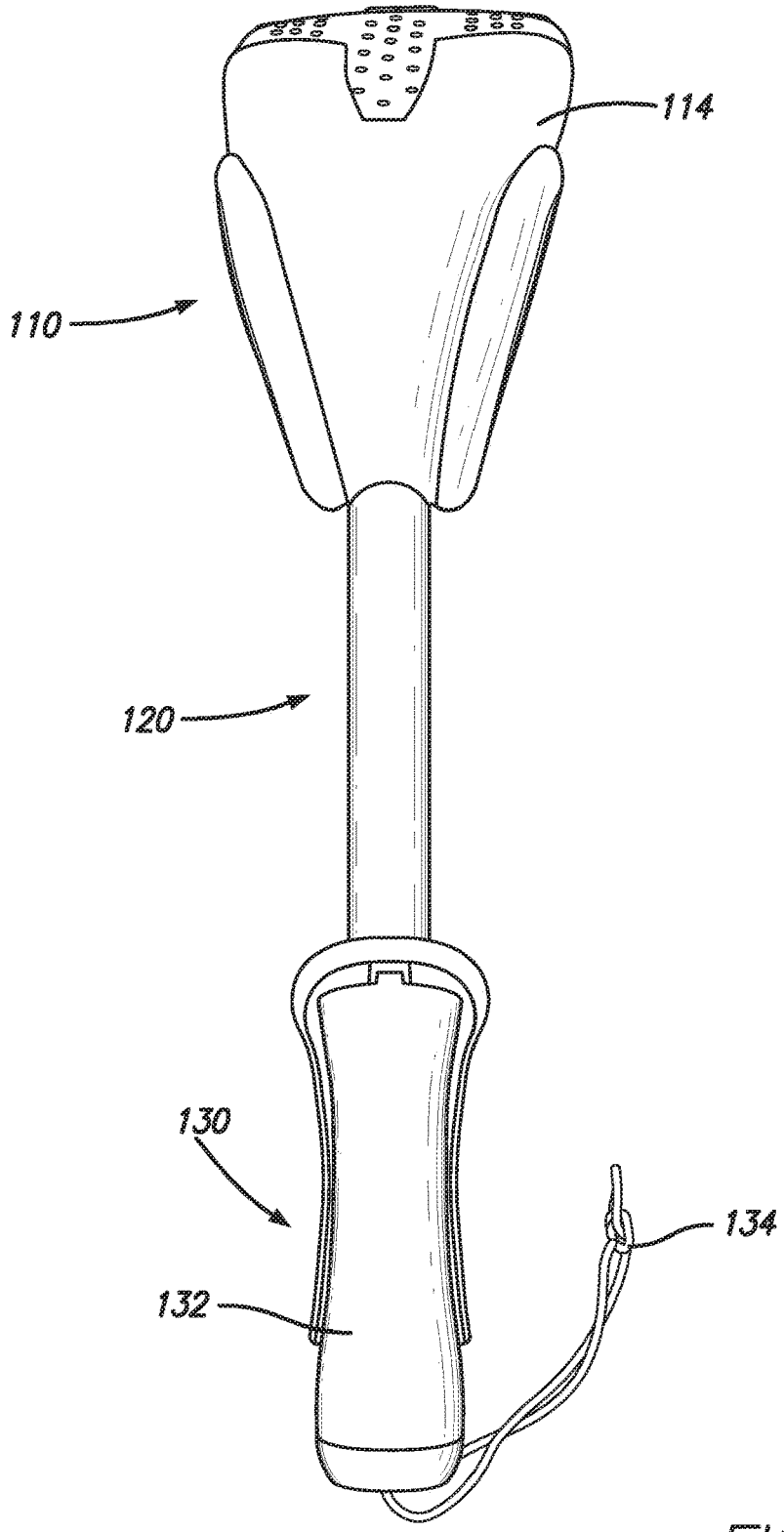
FIG. 3 is a rear view of the launching device of FIG. 1.

The embodiments of the launching device disclosed herein are designed to permit a single user to launch a projectile at an intended target. Various features of the launching device shown and described herein are configured to optimize both the accuracy, speed and distance with which a projectile, particularly a water balloon, is launched. While the launching device may be used to launch projectiles of a variety of sizes, dimensions, and weights, the launching device is specifically configured to be used in connection with launching water balloons.

Water balloons have certain features which make it particularly difficult to accurately hit an intended target that is located at a large distance away from the source. Water balloons, by their very nature, do not have a fixed shape may be rather amorphous. As a result, it is often difficult to be able to handle water balloons using one's own hands and throw them to hit an intended target, particularly when the water balloon must travel a large distance to reach the intended target.

In addition, water balloons are typically constructed from a thinner latex material to promote rupture upon impact. Thus, due to their fragile nature, water balloons are prone to rupturing prematurely, especially if it is not handled appropriately.

The launching devices disclosed here are specifically configured to prevent premature rupture of the water balloons while at the same time allowing the water balloons to be launched at a distance and speed greater than would be achieved by hand throwing.

FIGS. 1-4 depict an embodiment of the launching device comprising a head section 110, an elongated shaft 120 and a handle 130. The head section 110 comprises a cavity 112 which is configured and shaped to hold a water balloon (not depicted).

In one embodiment, the cavity 112 is an open pocket having walls that surround at least a portion, if not the entirety, of the water balloon. Preferably, the cavity 112 is configured such that in an upright position, the water balloon is maintained securely within the cavity 112. The cavity 112 may also have a curved or rounded surface without any sharp angles.

A launching ramp 114 extends both upwardly and outwardly along a launch axis which begins from the cavity and terminates in a distal portion 116 of the head section 110. The lateral or side surface of the launching ramp 114 may optionally be curved so as to maintain the water balloon along the launch axis. The launching ramp 114 may include a plurality of apertures 118 which reduces the drag or air resistance of the launching device as it is set into motion. The elongated shaft 120 comprises a first end coupled to the head section 110 and a second end that is coupled to the handle 130. The handle 130 generally comprises a grip section 132 having a longitudinal axis A-A (shown in FIG. 4). The handle 130 may optionally include a string loop 134 and guard member 136 to protect the user's hand when in use.

Figure 4:
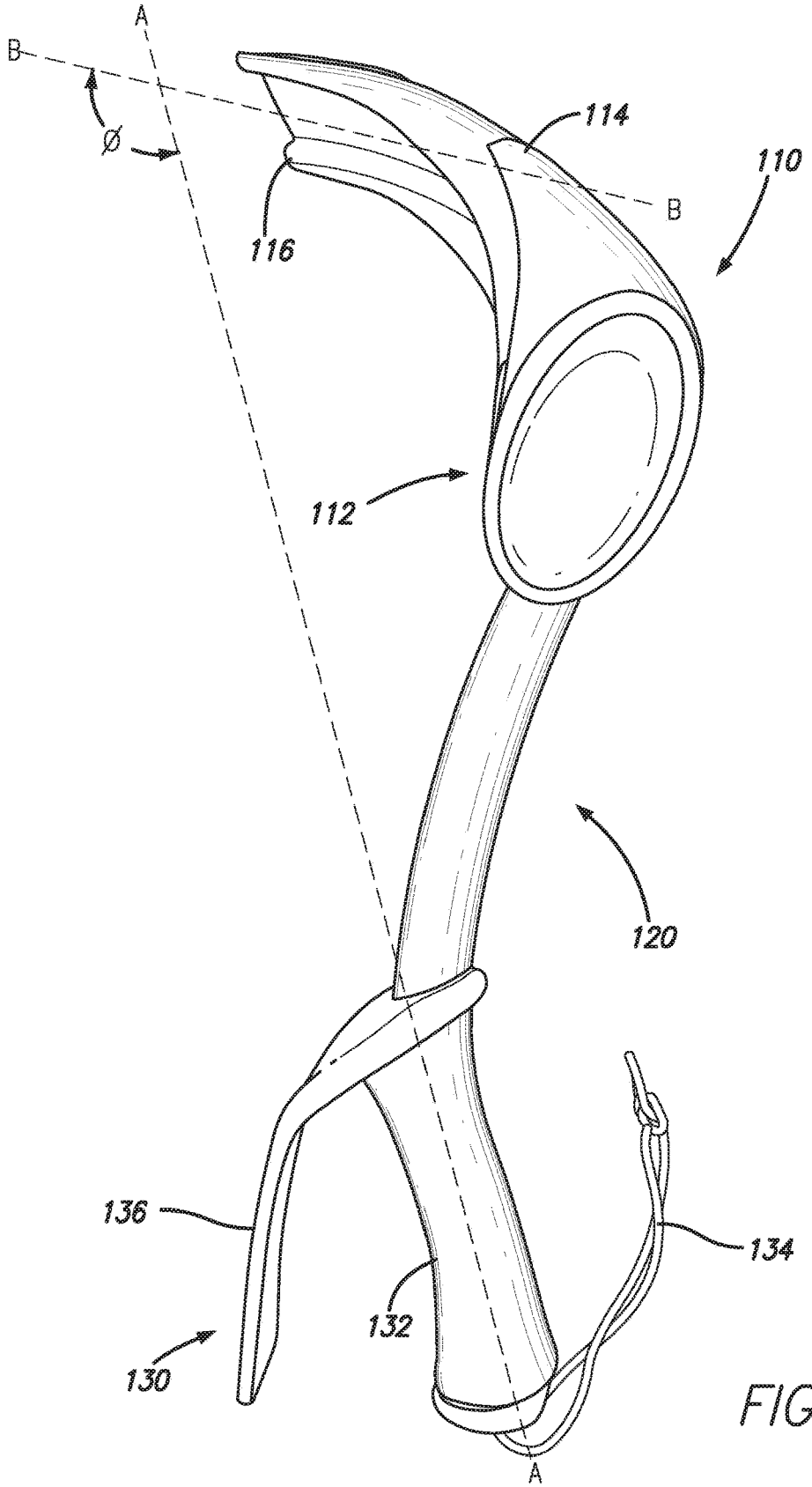
FIG. 4 is a side view of the launching device of FIG. 1.

In operation, a user may grasp the grip section 132 of the launching device with the head section 110 pointing upward. A water balloon or other projectile may be loaded into the cavity 112 and the water balloon may be launched out of the cavity by a forward rotational motion of the launching device, culminating in an abrupt stop or a flicking motion in a launching direction, as depicted in FIG. 4. The faster the forward rotational motion, the greater the velocity and distance traveled by the water balloon.

The launching device is configured so as to avoid premature rupture of the water balloon. In accordance with one embodiment, the surfaces contacting the water balloon during storage and launch are preferably smooth surfaces curved surfaces, devoid of sharp angles, edges or protrusions which may cause friction with the rolling of the water balloon.

Figure 5:
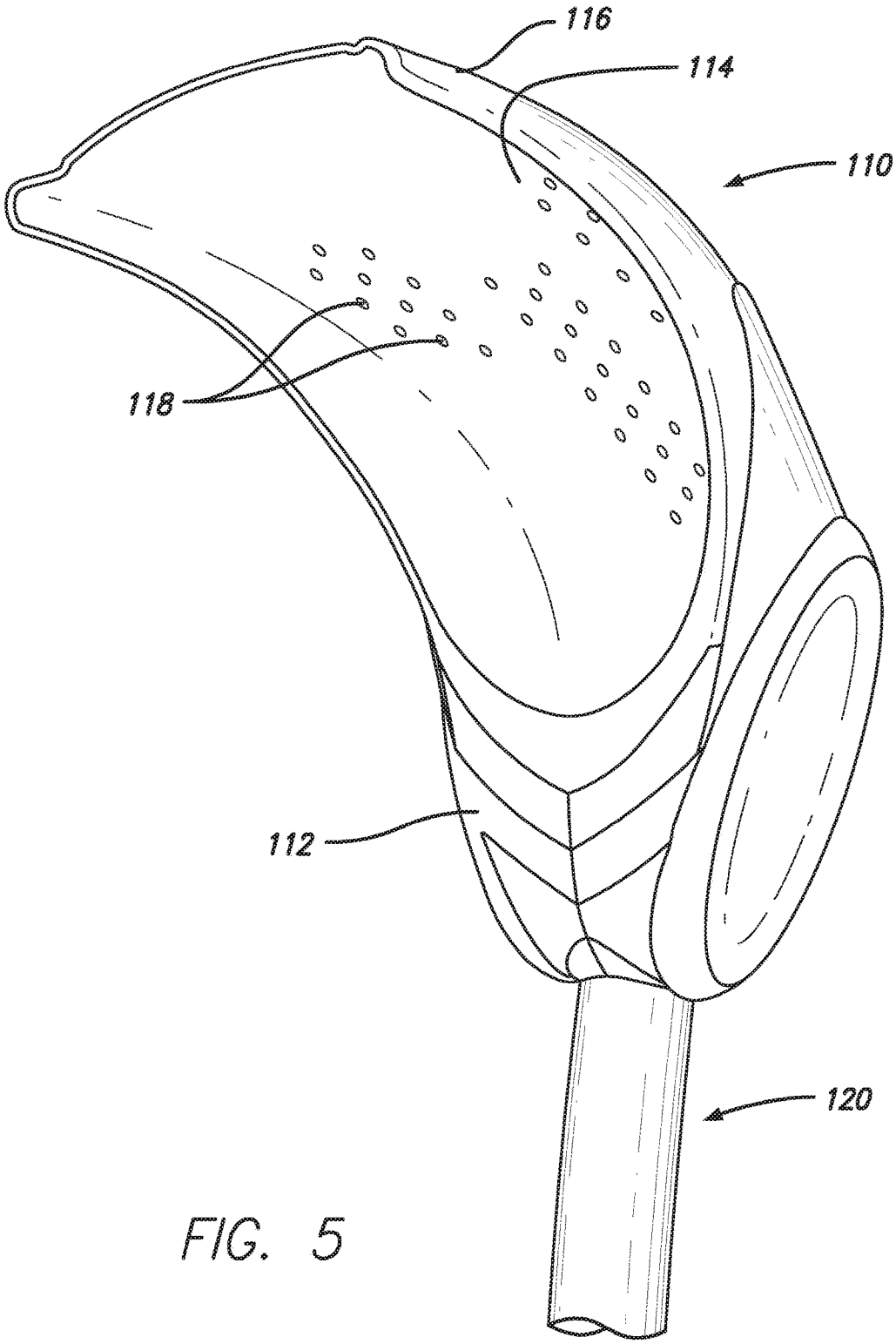
FIG. 5 is a perspective view of the head section of an embodiment of the launching device.
Figure 6:
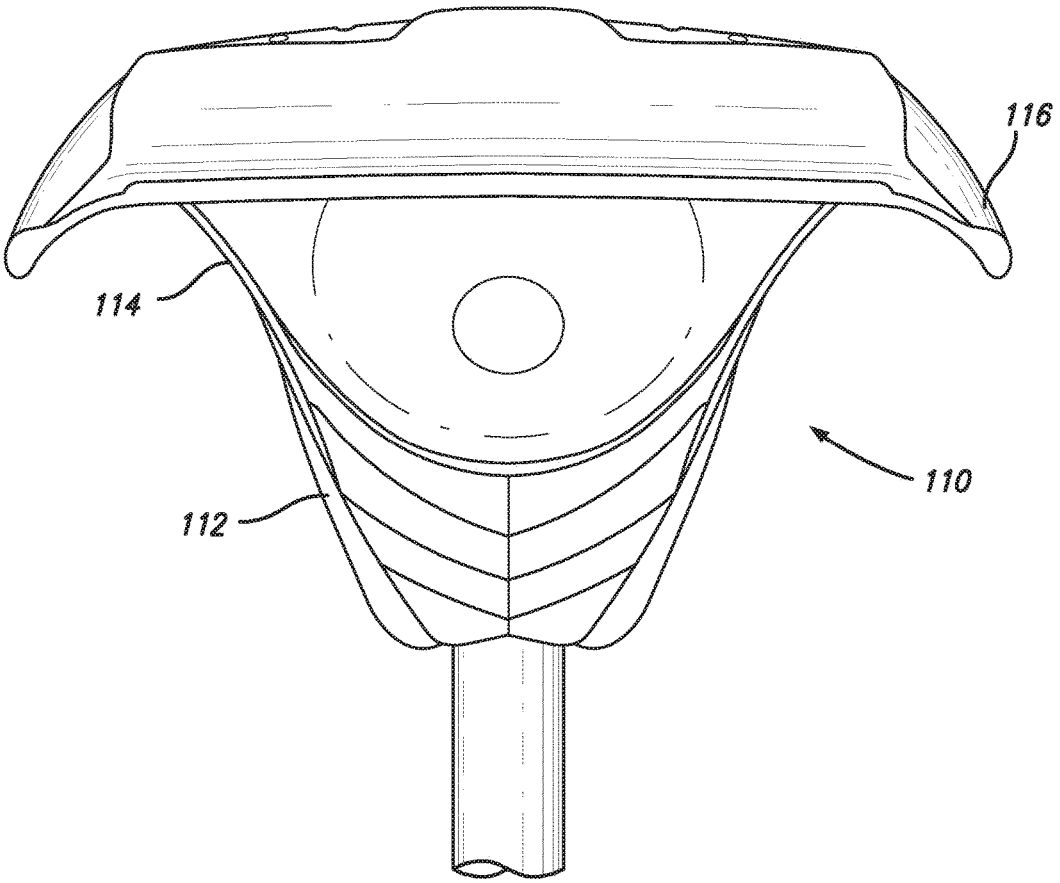
FIG. 6 is a top down view of the head section of the launching device of FIG. 5.

As shown in FIGS. 5-6, the head section 110 of the launching device comprises a cavity 112 which has a surrounding side wall and a bottom portion, thereby allowing for a water balloon to be seated securely within the cavity 112 when the launching device is held in an upright position as depicted in FIGS. 1-4.

A rolling surface is defined by the inner surface of the cavity 112 and the launch ramp 114. As shown in FIGS. 1-6, the launch ramp 114 is curved both upwardly and outwardly from the cavity 112 wherein a distal portion of the launch ramp extends outwardly beyond the cavity in a forward launching direction (see FIG. 4) along a launch axis. The rolling surface is specifically adapted to allow for the smooth rolling of the water balloon and the entirety of the rolling surface, again is devoid of sharp angles, edges or protrusions which would create friction when the water balloon is rolled thereon. While the rolling surface may include a plurality of apertures 118 to reduce wind resistance when the launching device is used, these apertures 118 are sufficiently small in size so as to not create significant friction. In a preferred embodiment, the largest diameter of the apertures is not greater than 10 mm, and preferably not greater than 5 mm.

The launching device is specifically configured to allow a user to accurately hit a target with a water balloon. Accordingly, the design of the launching device is not constrained so as to allow for the reciprocal "catching" of a projectile, although such may be accomplished.

As shown in FIG. 1-6, the distal portion 116 of the launch ramp 114 extends outwardly beyond the cavity 112 in a forward launching direction. While this may not be an optimal configuration for catching projectiles, it allows for a user to more accurately aim the water balloon at an intended target. In one embodiment, an angle θ is defined by the grip axis A-A and the distal portion 116 of the launch ramp 114 along axis B-B. In a preferred embodiment, the angle is greater than or equal to 90 degrees. In another preferred embodiment, the angle is in the range of from 110 to 170 degrees. In orienting the distal portion 116 of the launch ramp 114 relative to the grip axis A-A, the distal portion is configured so as to orient the exiting water balloon in a forward direction. In a preferred embodiment, proximal portion of the launch ramp 114 adjacent the cavity 112 is curved and the distal portion 116 has a substantially planar portion which defines the axis B-B from which the angle θ may be determined. In another preferred embodiment, the launch ramp 114 has a radius of curvature along its surface that increases from the proximal portion to the distal portion.

The launch device is also configured so as to maximize the speed at which the water balloon may be launched. To that end, the cavity 112 may be configured to be located at a distance away from the grip axis A-A and in a direction opposing the launching direction (see FIG. 4). In one preferred embodiment, the shaft 120 may comprise a curved shaft section between the first and second end such that the curved launch ramp and the curved shaft section form a sigmoidal curve. Such a configuration has the effect of increasing the distance and thus the angular momentum of the water balloon as it is thrown by the user. The angular momentum may further be increased by providing a longer shaft 130.

It is to be understood that the detailed description and specific examples, while indicating preferred embodiments of the present invention, are given by way of illustration and not limitation. Many changes and modifications within the scope of the present invention may be made without departing from the spirit thereof, and the invention includes all such modifications.

What is claimed is:

1. A water balloon launching device comprising a handle extending longitudinally a length from an end to a head of the device, the handle having a first section extending from a distal end of the handle and a second section extending from the head of the device toward the first section, wherein the handle first section extends in an axial direction different from the handle second section, the head comprising a cavity section for retaining a water balloon therein when the handle is positioned in a vertically-upright position, the head comprising an internal cavity and a ramp section extending away from the cavity section for guiding water balloon movement outwardly from the cavity section and along the ramp section when the handle is moved in a forward-directed rotational movement, the ramp section extends from the cavity a distance to a distal end of the ramp section, and wherein one or both of the cavity and the ramp section comprises one or more openings extending therethrough.

2. The device as recited in claim 1 wherein the handle first and second sections have an axial amount of departure of less than about 170 degrees as measured between rearmost portions of the first and second handle sections.

3. The device as recited in claim 1 wherein the axial amount of departure is less than about 150 degrees.

4. The device as recited in claim 1 wherein an angle is defined by the handle first section and the distal end of the ramp section.

5. The device as recited in claim 1 wherein the ramp section has a curved configuration so as to make contact with a partial diameter of the water balloon during a lunch movement to guide the water balloon along the ramp section during a launch movement.

6. A launching device for holding and launching a water balloon by forward rotational movement by a user, the device consisting of:

a cavity configured for retaining a water balloon therein when in a prelaunch condition;

a handle having a first section extending from a handle distal end and the handle having a second section extending longitudinally away from a first end of the cavity, the first and second handle sections having different angles of departure relative to one another; and a ramp extending from the cavity and configured to guide water balloon movement outwardly from the cavity therealong during a lunch movement of the handle.

7. The device as recited in claim 6 wherein the cavity has a radius of curvature that is different from a radius of curvature for the at least section of the ramp.

8. The device as recited in claim 6 wherein at least a section of the ramp is curved to contact a partial diameter of the water balloon during a lunch movement.

9. The device as recited in claim 6 wherein an angle is defined by a longitudinal axis along the grip and a distal end of the ramp.

10. The device as recited in claim 9 wherein the angle is greater than about 90 degrees.

11. The device as recited in claim 6 wherein the cavity includes a front section that partially covers a forward surface of a water balloon opposite the ramp when disposed therein.

12. The device as recited in claim 6 wherein a distal end of the ramp is configured having a width that is substantially planar in configuration.

13. The device as recited in claim 6 wherein the ramp section comprises one or more openings extending therethrough.

14. A method for launching a water balloon comprising the steps of:

placing a water balloon in a cavity of a launching device comprising a handle extending longitudinally therefrom and a ramp extending outwardly from the cavity, the ramp comprising an approximated radius of curvature along at least a section of the ramp that is different from an approximated radius of curvature for the cavity; and moving the handle in a forward rotational movement to cause the water balloon to move from the cavity along the ramp so that it is launched therefrom upon passing the ramp distal end.

15. The method as recited in claim 14 wherein during the step of moving, the handle is held along a grip by a user, and the grip has a longitudinal axis at an angle to an axis extending along the ramp distal end, wherein the angle is greater than 90 degrees.

16. The method as recited in claim 14 wherein during the step of placing, the device us held in an upright position with the handle extending vertically downwardly away from the cavity.

17. The method as recited in claim 14 wherein during the step of moving, at least a portion of the water balloon diameter is in contact with wall surfaces of the ramp to guide the water balloon prior to launching.

18. The method as recited in claim 14 wherein during the step of moving, the water balloon passes along one or more openings extending through the ramp.

19. The method as recited in claim 14 wherein the approximated radius of curvature along the at least section of the ramp is greater than the approximated radius of the cavity.

* * * * *